US010792952B1

(12) United States Patent
Lucash

(10) Patent No.: US 10,792,952 B1
(45) Date of Patent: Oct. 6, 2020

(54) PROMOTIONAL ITEM WITH WRITING INSTRUMENT AND BOX

(71) Applicant: Hub Pen Company, LLC, Braintree, MA (US)

(72) Inventor: Jason Lucash, Danville, CA (US)

(73) Assignee: Hub Pen Company, LLC, Braintree, MA (US)

( * ) Notice: Subject to any disclaimer, the term of this patent is extended or adjusted under 35 U.S.C. 154(b) by 0 days.

(21) Appl. No.: 16/822,617

(22) Filed: Mar. 18, 2020

(51) Int. Cl.
*B43K 29/20* (2006.01)
*G09F 23/00* (2006.01)
*A45C 11/34* (2006.01)

(52) U.S. Cl.
CPC ..... *B43K 29/20* (2013.01); *A45C 11/34* (2013.01); *G09F 23/00* (2013.01); *G09F 2023/0016* (2013.01); *G09F 2023/0025* (2013.01)

(58) Field of Classification Search
CPC ..... B43K 29/20; B43K 31/00; G09F 23/00; G09F 2023/0016; G09F 2023/0025; A45C 11/34; A45C 11/36
See application file for complete search history.

(56) References Cited

U.S. PATENT DOCUMENTS 2,105,424 A * 1/1938 Kahn ..... A45C 11/34 221/246
3,630,344 A * 12/1971 Bergh ..... A45C 11/34 206/777
5,495,938 A * 3/1996 Bedford ..... A45C 11/34 206/214
6,074,115 A * 6/2000 Fantinelli ..... A45C 11/34 401/194
6,196,388 B1 * 3/2001 Kaposvari ..... A45C 11/34 206/214
7,086,798 B1 * 8/2006 Cetera ..... B43K 25/026 401/195
2003/0164821 A1 * 9/2003 Rezania ..... B43K 29/08 345/179
2003/0235455 A1 * 12/2003 Chao ..... B43K 29/20 401/131
2006/0228162 A1 * 10/2006 Cetera ..... A45D 34/00 401/195
2007/0053738 A1 * 3/2007 Raeder ..... B43K 7/005 401/192
2009/0055318 A1 * 2/2009 Borkowski ..... G06Q 20/105 705/41

OTHER PUBLICATIONS

U.S. Appl. No. 29/728,396, filed May 18, 2020, Lucash et al.

* cited by examiner

*Primary Examiner* — Gary C Hoge
(74) *Attorney, Agent, or Firm* — Thorpe, North & Western, LLP

(57) ABSTRACT

A promotional item comprises a writing instrument having a substantially flat surface and a box carrying the writing instrument and having a top with a flat surface. A matching recess in the box has an opening in the flat surface matching a profile of the writing instrument. The flat surface of the writing instrument is flush with the flat surface of the box when the writing instrument is carried by the box and positioned in the recess. Promotional indicia is disposed on the flat surface of the box and the flat surface of the writing instrument.

19 Claims, 8 Drawing Sheets

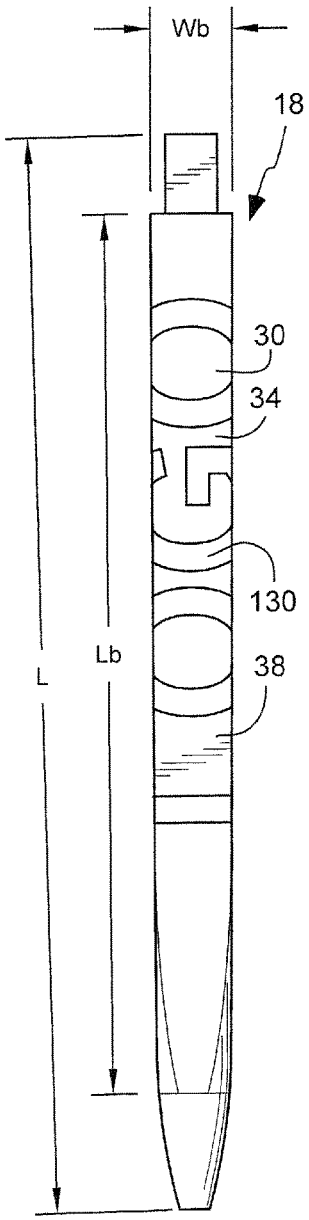
Fig. 7
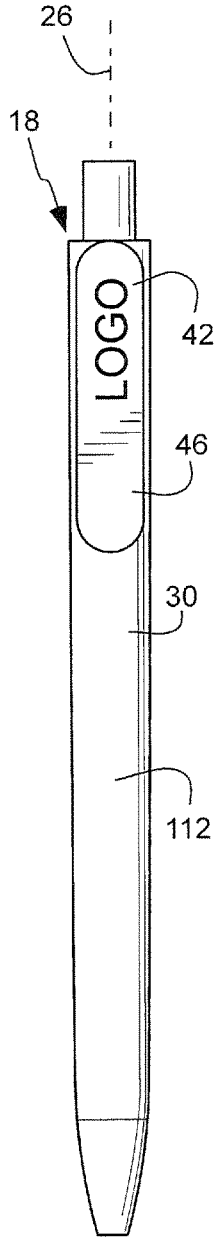
Fig. 8
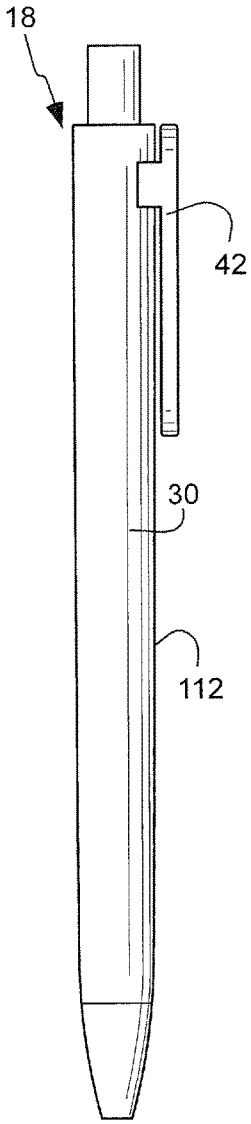
Fig. 9
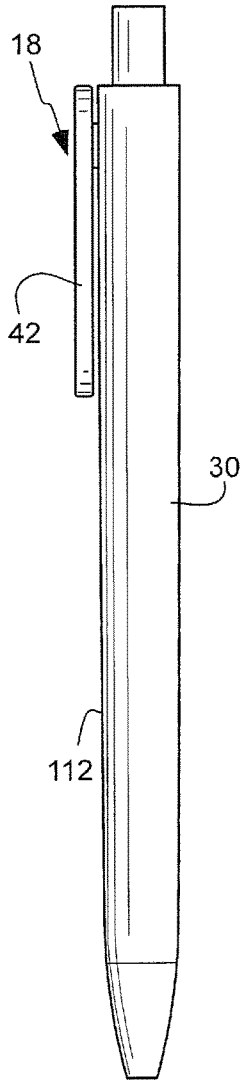
Fig. 10
Fig. 11
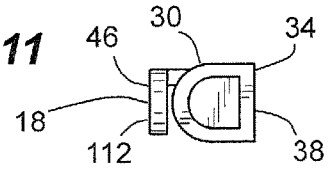
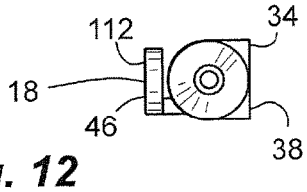
Fig. 12

PROMOTIONAL ITEM WITH WRITING INSTRUMENT AND BOX

BACKGROUND

Pens are common promotional items and are often given away by promotors. Pens can be popular promotional items because they are frequently used, and thus position promotional material in view of the user. Their common use can also lead to promotional pens being readily discarded and ignored. The improvement of promotional items is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein:

FIG. 7 is a top view of a writing instrument of the promotional item of FIG. 1.

FIG. 8 is a bottom view of the writing instrument of FIG. 7.

FIG. 9 is a side view of the writing instrument of FIG. 7.

FIG. 10 is an opposite side view of the writing instrument of FIG. 7.

FIG. 11 is a proximal end view of the writing instrument of FIG. 7.

FIG. 12 is a distal end view of the writing instrument of FIG. 7.

Figure 1:
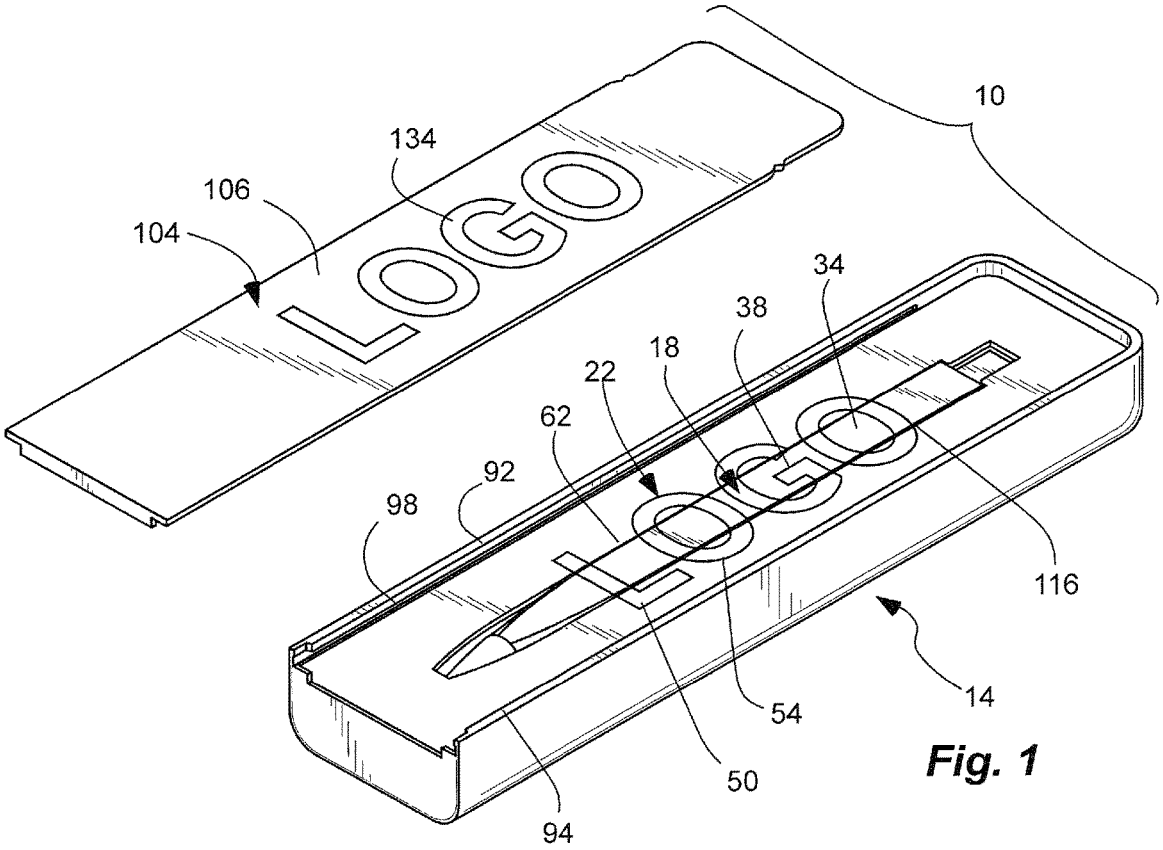
FIG. 1 is a perspective view of a promotional item in accordance with an embodiment of the invention, shown with a box lid in an open position and removed from a box.
Figure 2:
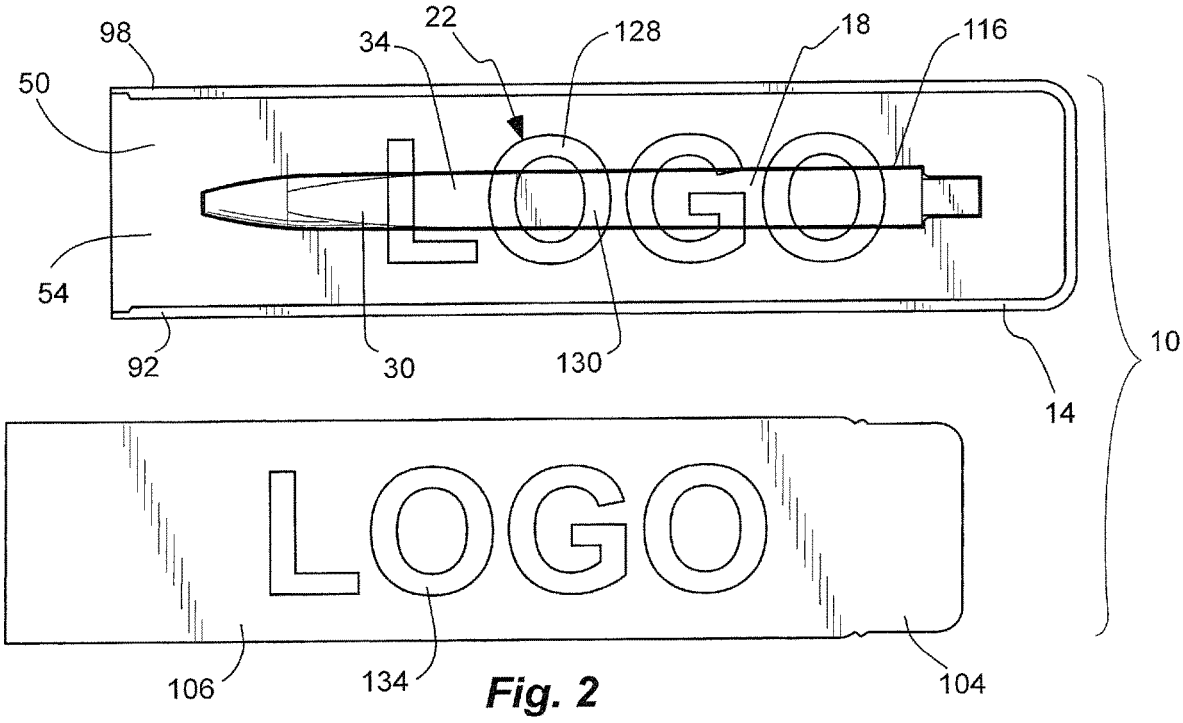
FIG. 2 is a top view of the promotional item of FIG. 1, shown with the box lid in the open position and removed from the box.
Figure 3:
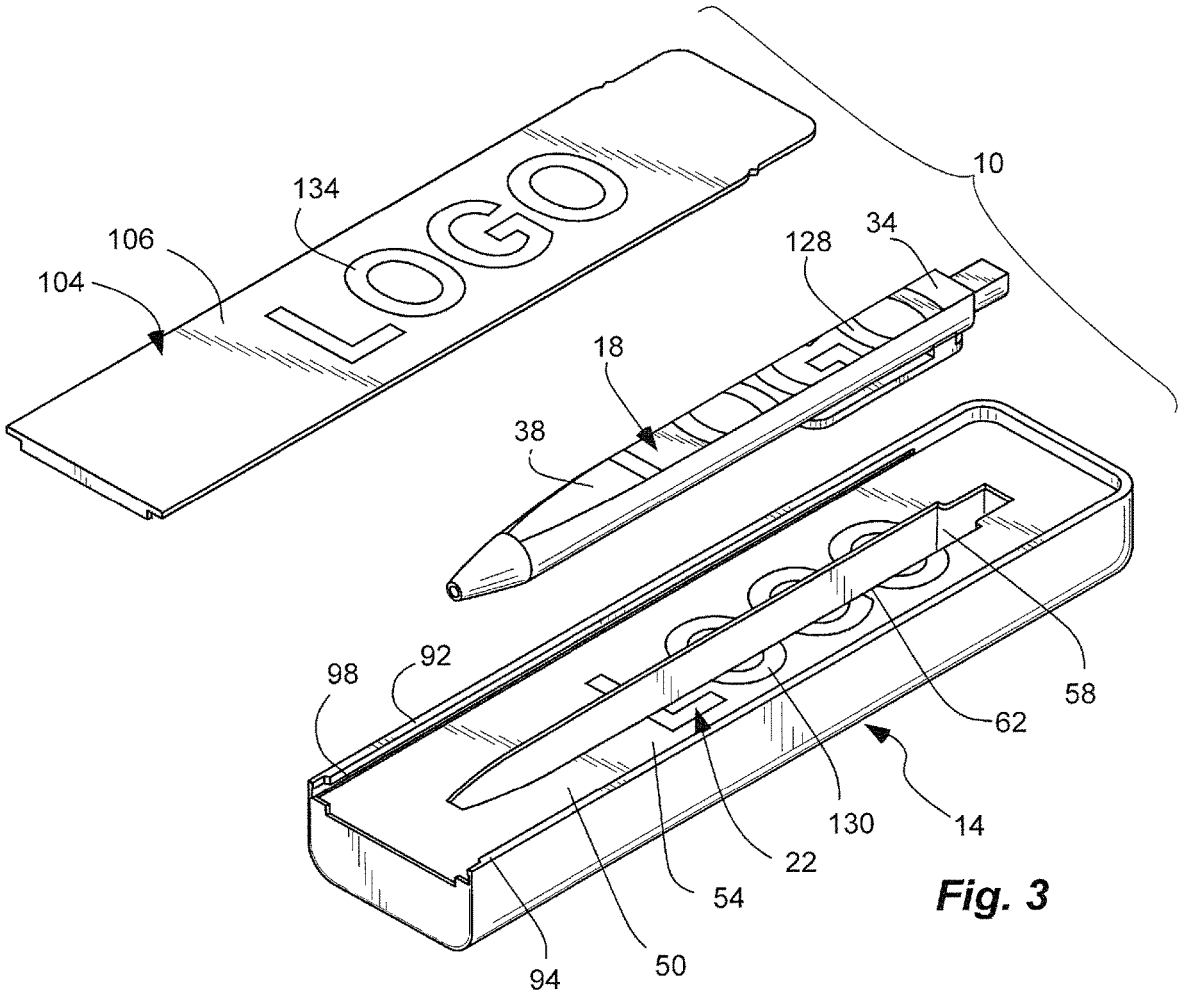
FIG. 3 is an exploded perspective view of the promotional item of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION

Although the following detailed description contains many specifics for the purpose of illustration, a person of ordinary skill in the art will appreciate that many variations and alterations to the following details can be made and are considered to be included herein.

Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

"The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

As used herein, "enhanced," "improved," "performance-enhanced," "upgraded," and the like, when used in connection with the description of a device or process, refers to a characteristic of the device or process that provides measurably better form or function as compared to previously known devices or processes. This applies both to the form and function of individual components in a device or process, as well as to such devices or processes as a whole.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the relative placement of one object with respect to another object. In some examples, objects that are described as being "adjacent" to one another may be in a side-by-side or other similar positional relationship that can include objects that are in direct contact with one another and objects that are in close proximity to one another. The exact degree of proximity may in some cases depend on the specific context.

As used herein, "coupled" refers to a relationship of connection or attachment between one item and another item, and includes relationships of either direct or indirect connection or attachment. Any number of items can be coupled, such as materials, components, structures, layers, devices, objects, etc.

As used herein, "directly coupled" refers to a relationship of physical connection or attachment between one item and another item, where the items have at least one point of direct physical contact.

As used herein, "indirectly coupled" refers to a relationship of connection or attachment between one item and another item where the items do not have a point of direct physical contact with one another. Rather, such items can be connected, attached, or joined together by an intermediate item. For example, when a first layer of material is bound or joined to a second layer of material using an intermediate layer in between the first and second layer, the first and second layers can be said to be indirectly coupled.

Unless otherwise specified, the terms "writing instrument", "writing utensil" and "writing implement" are used interchangeably herein to a device used for writing, and that can be manipulated by hand to cause writing on a surface. In one aspect, the writing instrument can be a pen containing ink. The pen can be a ball point pen and can have an ink cartridge with an elongated ink reservoir with a ball carried at a distal end such that rolling the ball on a surface transfers ink from the reservoir to the surface. In addition, the pen can be a mechanical pen and can have a deployment and retraction mechanism that extends and withdraws the distal end and ball. In another aspect, the writing instrument can be a fountain pen. In another aspect, the writing instrument can be a pencil with a graphite core. In another aspect, the pencil can be a mechanical pencil with a mechanism for advancing an elongated graphite rod. Furthermore, the writing instrument can be a stylus with a distal tip that can be sensed by an electronic screen.

Unless otherwise specified, the terms "promotional indicium" and "promotional indicia" are used interchangeably herein. The promotional indicia comprises a name, logo, slogan, trademark, service mark, etc. that is capable of identifying and/or distinguishing a business or company, or product or service, or both, or can otherwise be utilized to market, promote, and/or brand the business or company, or product or service, or both. The indicium can be indicative of such a business, and can comprise a name, logo, slogan, trademark, service mark, etc.

The terms "business", "company" are used broadly and interchangeably herein to refer to an organization that provides a product or a service.

The terms "interference fit" and "friction fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

A promotional item and gift set comprises a writing instrument and a presentation box. Both the writing instrument and the presentation box can carry and present promotional indicia. Both the writing instrument and the presentation box can have a flat surface for the promotional indicia. The presentation box can have a cavity to receive the writing instrument therein, with the flat surface of the writing instrument flush with the flat surface of the presentation box, and with the promotional indicia continuous from the flat surface of the presentation box to the flat surface of the writing instrument. The box and writing instrument can provide a more memorable token with greater perceived value along with a greater surface are for the promotional indicia.

Referring to FIGS. 1-27, one example of promotional item 10 is shown with a box 14 to present a writing instrument 18 along with promotional indicia 22. In one aspect, the writing instrument 18 can be a pen, as shown. The box 14 can selectively and removably carry the writing instrument 18. The promotional indicia 22 can be indicative of a business, and can comprise a name, logo, slogan, trademark, service mark, etc.

The writing instrument 18 can have a longitudinal axis 26 along a long dimension and length L of the writing instrument. In addition, the writing instrument 18 can have a barrel 30 with a lateral side 34 having a substantially flat surface 38. The flat surface 38 can extend longitudinally substantially an entire length Lb of the barrel 30, and great majority of the length L of the writing instrument 18. In addition, the flat surface 38 can extend laterally substantially an entire width Wb of the barrel 30. The remainder of the barrel 30 and the writing instrument 18 can have an arcuate and rounded longitudinal profile transitioning to the flat surface 38 of the lateral side 34. In addition, the flat surface 38 of the lateral side 34 of a proximal end of the barrel 30 can taper to a narrower width and a more rounded longitudinal profile to facilitate a comfortable grip.

The barrel 30 can be hollow, and can define a tube. The writing instrument 18 can have a distal tip at a distal end of the barrel 30 with an open end through which an ink tip with a ball point can be selectively extended. The writing instrument 18 can also have a proximal button at a proximal end of the barrel 30 that can be repeatedly depressed to selectively extend and retract the ink tip with the ball point. The writing instrument 18 can also have a clip 42 at the proximal end of the barrel 30 and opposite the lateral side 34 with the flat surface 38. The clip 42 can also have a flat surface 46.

The box 14 can selectively receive and carry the writing instrument 18. The box 14 can be elongated, and can have a longitudinal length greater than a lateral width or a height. The box 14 has a top 50 that is exposable and outwardly facing, and with a flat surface 54. The box 14 also has a matching recess 58 therein with an opening 62 in the flat surface 54 that substantially matches a profile of the writing instrument 18. The recess 58 can be sized and shaped to match the writing instrument 18. In one aspect, the recess 58 can have a depth and a shape to receive the writing instrument 18 therein. In another aspect, the flat surface 54 of the box 14 can extend continuously and uninterrupted from the opening 62 of the recess 58 to substantially an outer perimeter of the top 50.

In one aspect, the box 14 can comprise a bottom shell 66 with a bottom wall 70, opposite lateral side walls 72 and 74, and opposite end walls 76 and 78, and a closable top opening 80. In addition, the box 14 can also comprise a top shell 84 coupled to the bottom shell 66 and closing the top opening 80 of the bottom shell. The top shell 84 can comprise the flat surface 50 and the opening 62 to the recess. In another aspect, the top shell 84 can comprise the matching recess 58 of the box 14. In one aspect, the top and bottom shells 84 and 66 can be secured with a snap fit 88 therebetween. The snap fit 88 can comprise hooks extending from the top shell 84 and engaging indentations in the bottom shell 66.

Figure 4:
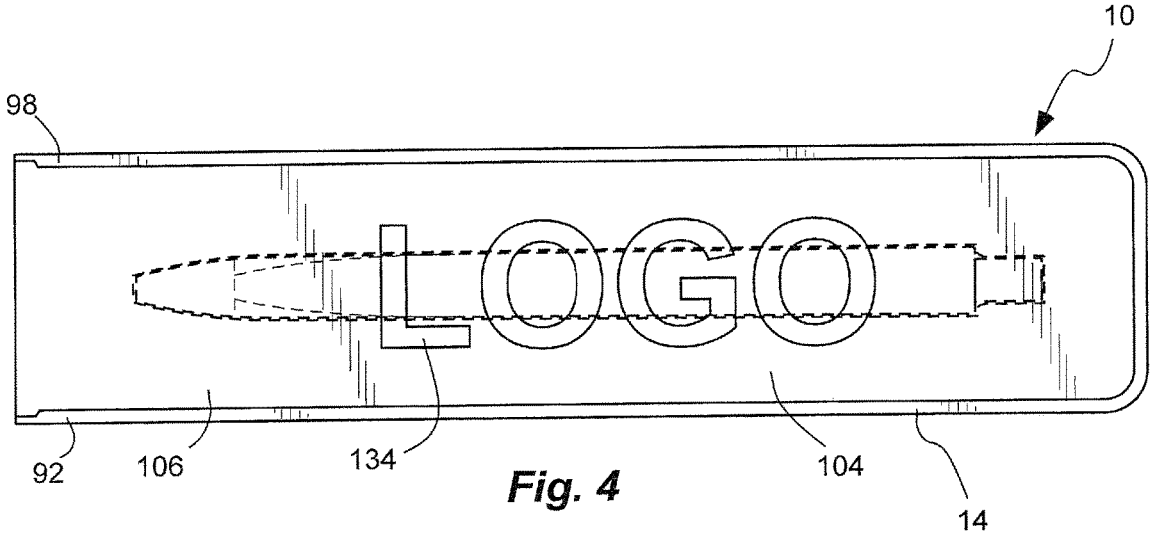
FIG. 4 is a top view of the promotional item of FIG. 1, shown with the box lid in a closed position.
Figure 5:
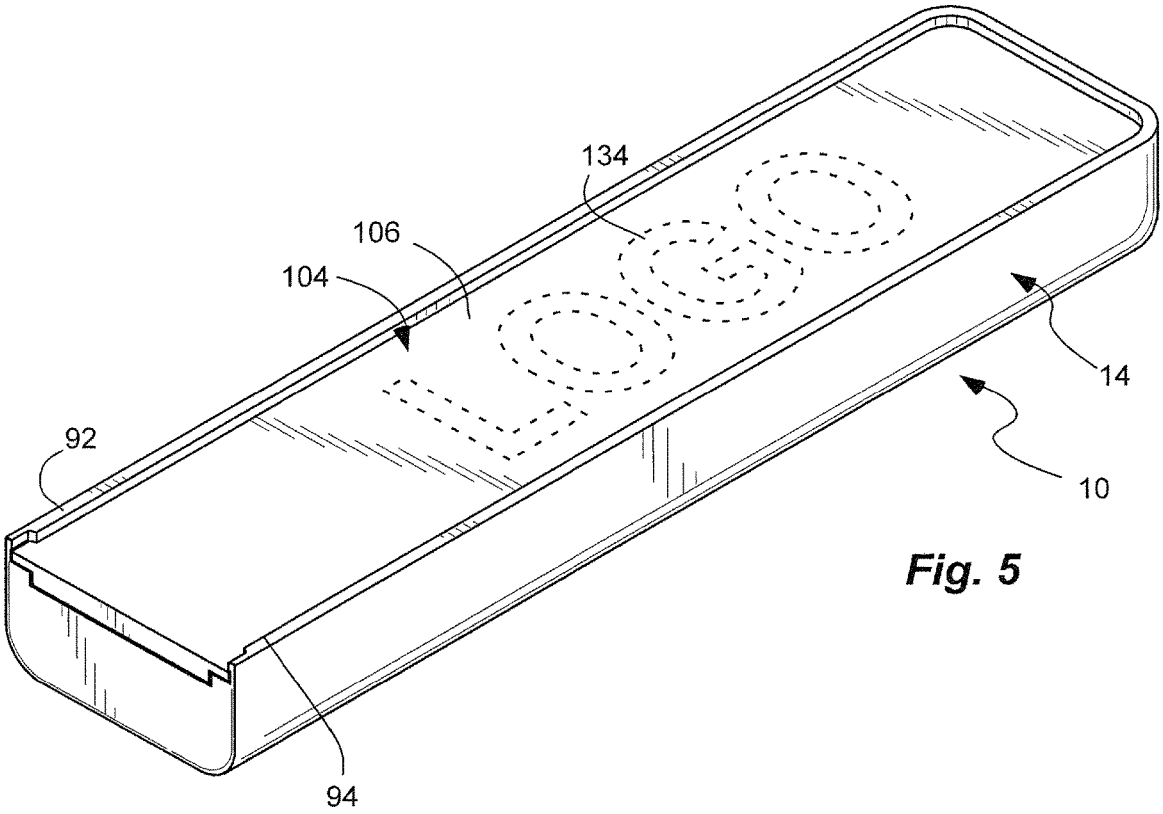
FIG. 5 is a perspective view of the promotional item of FIG. 1, shown with the box lid in the closed position.
Figure 6:
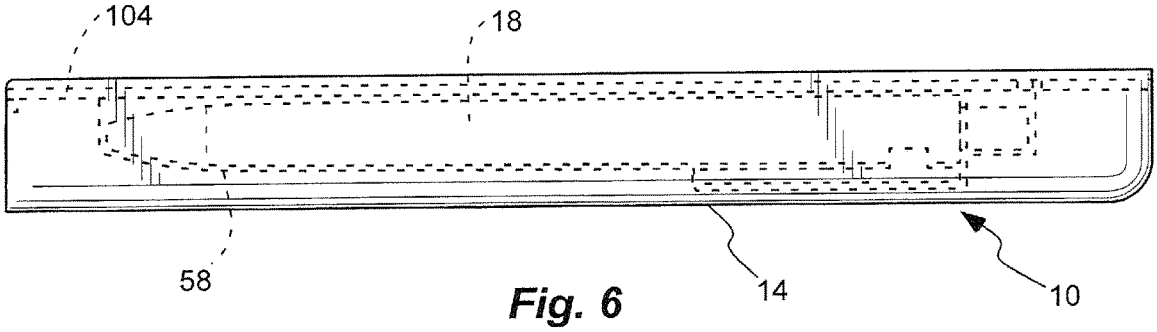
FIG. 6 is a side view of the promotional item of FIG. 1.
Figure 13:
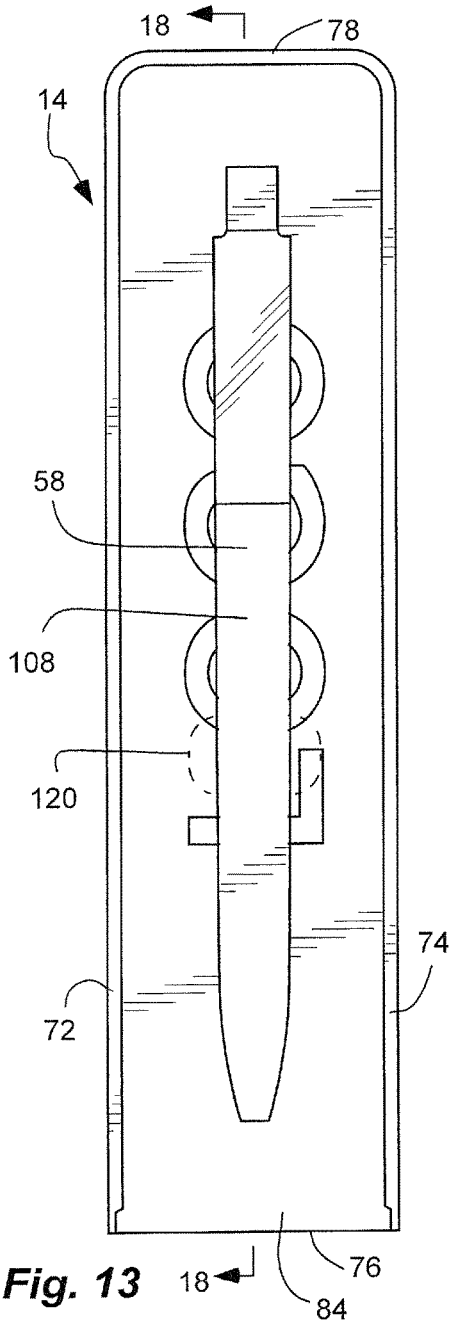
FIG. 13 is a top view of the box of the promotion item of FIG. 1.
Figure 14:
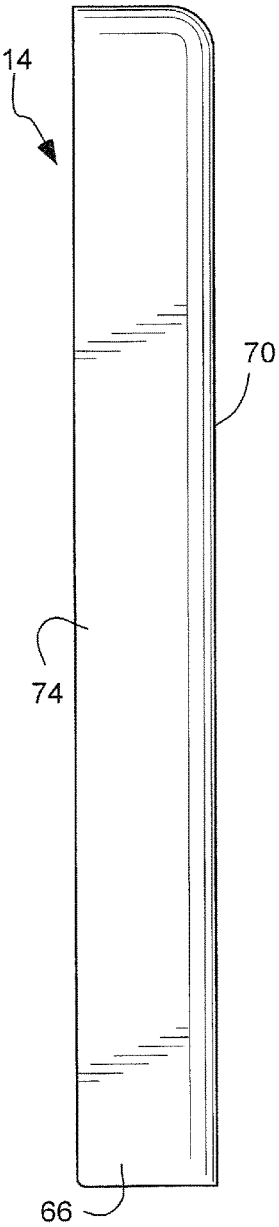
FIG. 14 is a side view of the box of FIG. 13.
Figure 15:
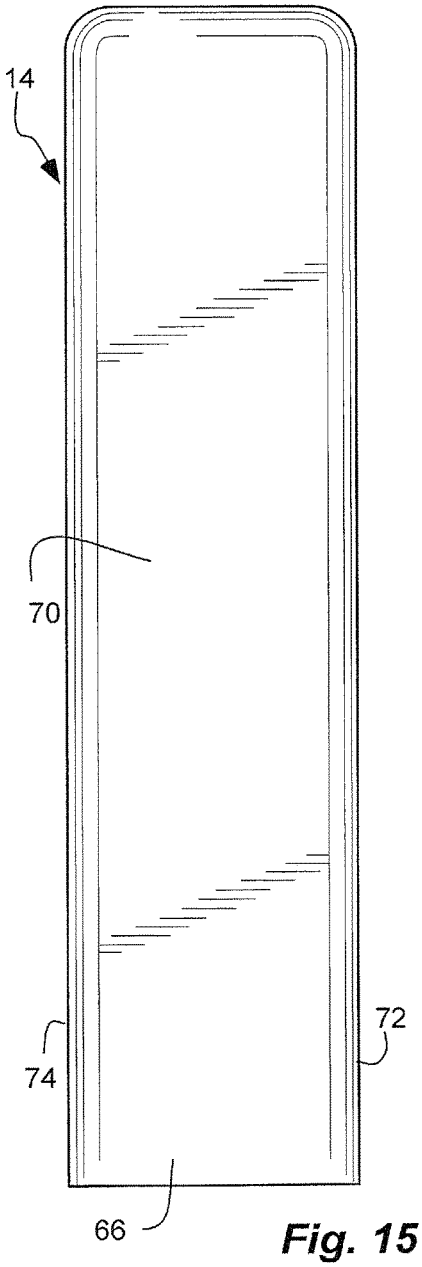
FIG. 15 is a bottom view of the box of FIG. 13.
Figure 16:
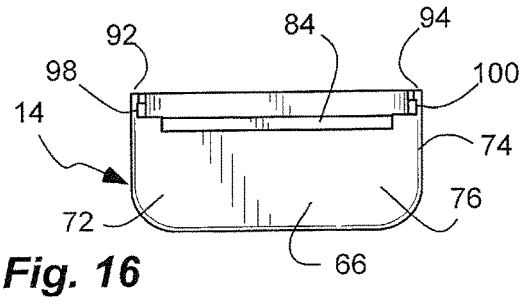
FIG. 16 is an end view of the box of FIG. 13.
Figure 17:
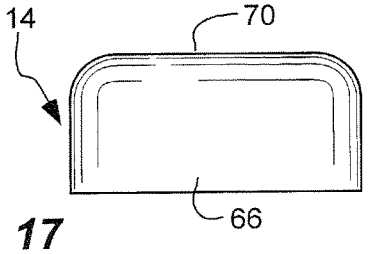
FIG. 17 is an opposite end view of the box of FIG. 13.

In another aspect, the top shell 84 can be recessed with respect to the opposite lateral side walls 72 and 74 of the lower shell 66 to define a pair of opposite rails 92 and 94 raised above the top shell 84 and the flat surface 50 of the box 14. A pair of opposing channels 98 and 100 can be formed in the pair of opposite rails 92 and 94, and can face one another. A box lid 104 can be slidable in the pair of opposing channels 98 and 100 between an open position exposing the recess, and a closed position covering the recess, as shown in FIGS. 4 and 5. The box lid 104 can selectively cover the top 50 of the box 14, and the recess 58, and the writing instrument 18 when positioned in the recess 58. The box lid 104 has an outer surface 106 facing outward with respect to the box 14 and the recess 58. The box lid 104 can have a press-fit or an interference-fit with the box 14 and the channels 98 and 100 and rails 92 and 94 thereof. In one aspect, the flat surface 50 of the box 14 extends from the opening 62 of the recess 58 to the opposite rails 92 and 96, and opposite ends of the box 14.

The box 14, the top shell 84 and the recess 58 can be configured so that the flat surface 38 of the writing instrument 18 and the flat surface 54 of the box 14 and the stop shell 84 are substantially flush with one another when the writing instrument 18 is carried by the box 14 and positioned in the recess 58. Thus, the flat surfaces 38 and 54 can be coplanar, even and level with one another. In one aspect, the recess 58 can be sized and shaped to position the writing instrument 18 therein with the flat surface 38 of the lateral side 34 of the writing instrument 18 to be substantially flush with the flat surface 54 of the box 14 and the top shell 84. The recess 58 can have a bottom 108 (FIG. 13) shaped to match an opposite lateral side 112 (FIGS. 8-12) of the writing instrument 18, that is opposite the lateral side 34 with the flat surface 38. The bottom 108 of the recess can be shaped to match a curved shape of the opposite lateral side 112 of the writing instrument 18. In addition, the bottom 108 can have different elevational heights to accommodate both the opposite lateral side 112 and the clip 46 of the writing instrument 18.

As described above, the recess 58 has an opening 62 that matches a profile of the writing instrument 18. The opening 62 and the writing instrument 18 can be sized and shaped to have a close fit. In one aspect, a gap 116 can be formed between the writing instrument 18 and the top 50 of the box 14, and between the flat surface 54 of the box 14 and the writing instrument 18. The gap 116 can have a small distance between the lateral side 34 of the writing instrument 18 and the top 50 of the box 14 for at least a majority of a longitudinal length of the lateral side 34 of the writing instrument 18, and thus between a majority of the flat surface 54 of the box 14 and the flat surface 38 of the writing instrument 18. The small distance can be less than 2 mm, in one aspect; less than 1 mm in another aspect; and less than 0.5 mm in another aspect. Thus, continuity and consistency of the flat surfaces 54 and 38 of the box 14 and the writing instrument 18 can be maximized. In one aspect, the flat surfaces 54 and 38 of the box 14 and the writing instrument 18 can be continuous and uninterrupted except for the gap 116, and distal end of the writing instrument 18 which is tapered, and the proximal button at the proximal end of the writing instrument 18.

In one aspect, the writing instrument 18 can be removed from the box 14 and the recess 58 by inverting the box 14 and allowing the writing instrument 18 to fall from the recess 58 under the force of gravity. In another aspect, the writing instrument 18 can be removed from the box 14 by pressing one end of the writing instrument 18 towards the box 14 and causing the opposite end of the writing instrument to elevate out of the recess 58. The bottom 108 of the recess 58 can have a rib and fulcrum, a pocket, or both, to receive the end of the writing instrument when pushed. In another aspect, the writing instrument 18 can be removed from the box 14 by grasping the writing instrument 18. The box 14 and the top shell 84 can have a finger notch (shown in phantom line 120 in FIG. 13) formed in the top 50 adjacent to the recess 58 to facilitate insertion of a finger and fingertip to grasp the writing instrument 18. The finger notch 120 can be formed on both sides of the recess 58 and can form part of the recess 58. In another aspect, the writing instrument 18 and the recess 58 can have an interference fit therebetween.

The promotional indicia 22 can be disposed on the flat surface 54 of the box 14 and the flat surface 38 of the writing instrument 18. The promotional indicia 22 can comprise a theme or design that is continuous across the flat surfaces 54 and 38, except for the gap 116 that may cause a de minimis interruption in the theme or design. The promotional indicia 22 can comprise a box indicium 128 on the flat surface 54 of the box 14 and a writing instrument indicium 130 on the flat surface 38 of the writing instrument 18. The writing instrument indicium 130 can match the box indicium 128 such that the box indicium 128 continues from the flat surface 54 of the box 14 to the flat surface 38 of the writing instrument 18 except for the gap 116 between the flat surface 54 of the box 14 and the writing instrument 18. Both the box indicium 128 and the writing instrument indicium 130 together can form a complete promotional indicia 22. In one aspect, the indicia 22 can cover all of the flat surfaces. For example, the box indicium 128 can cover the entire flat surface 54 of the box 14, while the writing instrument indicium 130 can cover the entire flat surface 38 of the writing instrument 18. The promotional indicia 22 can be indicative of a business, and can comprise a name, logo, slogan, trademark, service mark, etc. The promotional indicia 22 can be a visible surface treatment on the flat surfaces 54 and 38. The promotional indicia 22 can be printed, embossed, molded, etc.

The flat surface 38 of the writing instrument 18 provides a greater and more visible surface area for the writing instrument indicium 130. The flat surface 54 of the box 14 allows for the box indicium 128, and the box indicium 128 supplements the writing instrument indicium 130, allowing for the promotional indicia 22 to be greater than just the writing instrument indicium 130. In addition, the box indicium 128 can be supplemental to the writing instrument indicium 130. The lateral side 34 and the flat surface 38 of the writing instrument 18 can have a surface area of approximately 2 square inches, while the top 50 and the flat surface 14 of the box 14 can have a surface area of approximately 10 square inches (not including the recess), or a ratio of 1:5. Thus, the flat surface 54 of the box 14 can provide five times as much visible area for the promotional indicia 22 as the flat surface 38 of the writing instrument 18. A ratio of the flat surface 38 of the writing instrument 18 to the flat surface 54 of the box 14 can be approximately 1:8 in one aspect; 1:7 in another aspect; 1:6 in another aspect; 1:5 in another aspect; 1:4 in another aspect; 1:3 in another aspect; and 1:2 in another aspect. The flat surface 54 of the box 14 can be up to eight times the flat surface 38 of the writing instrument 18 in one aspect; up to seven times in another aspect; up to six times in another aspect; up to five times in another aspect; up to four times in another aspect; up to three times in another aspect; and up to two times in another aspect.

The box lid 104 and the outer surface 106 thereof can also have an outer indicium 134 that matches and compliments the promotional indicia 22 and the indicia 128 and 130 on the box 14 and the writing instrument 18. In one aspect, the outer indicium 134 can be the same as the indicia 128 and 130 on the box 14 and the writing instrument 18, except for the gap 116. In one aspect, the outer indicium 134 can cover the entire outer surface 106 of the box lid 104, and at least the entire visible outer surface 106 thereof when in the closed position received between the rails 94 and 98.

Figure 19:
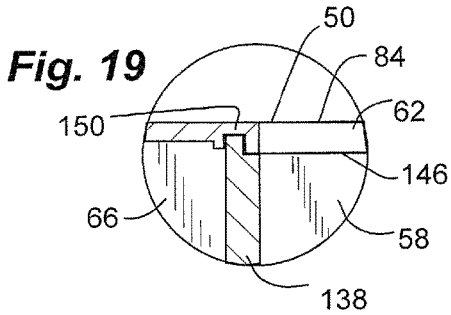
FIG. 19 is a detailed partial cross-sectional side view of the box of FIG. 13, taken along line 19 of FIG. 18.
Figure 18:
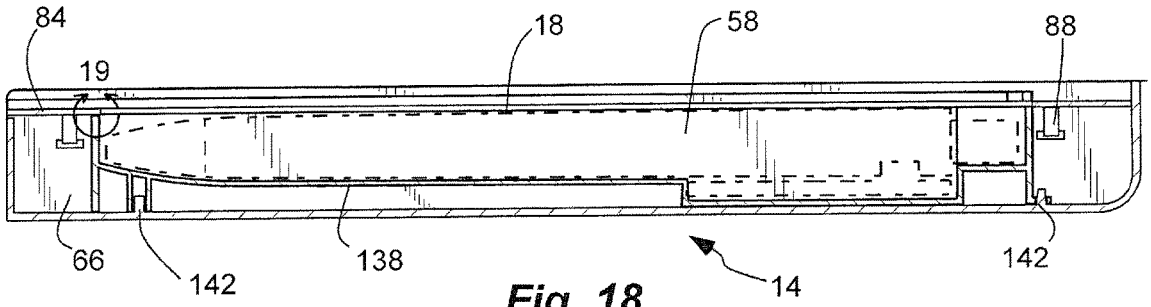
FIG. 18 is a cross-sectional side view of the box of FIG. 13, taken along line 18 of FIG. 13.
Figure 20:
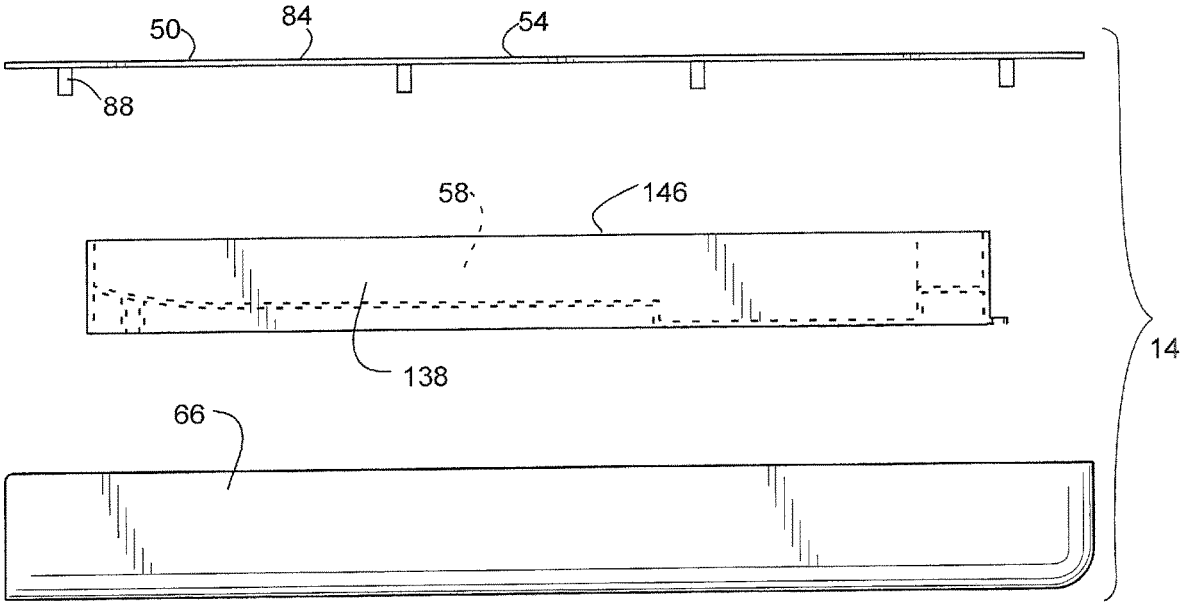
FIG. 20 is an exploded side view of the box of FIG. 13.
Figure 24:
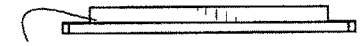
FIG. 24 is an end view of the box lid of FIG. 21.
Figure 21:
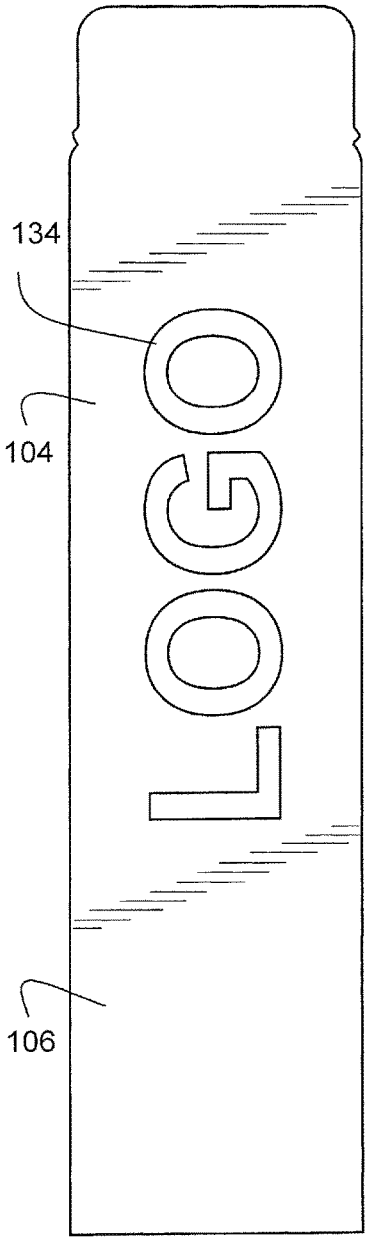
FIG. 21 is a top view of the box lid of the promotion item of FIG. 1.
Figure 22:
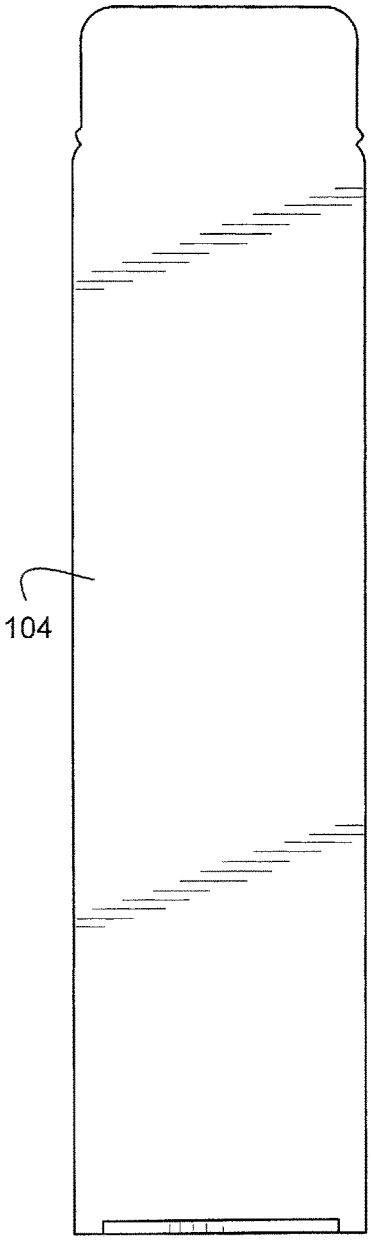
FIG. 22 is a bottom view of the box lid of FIG. 21.
Figure 23:
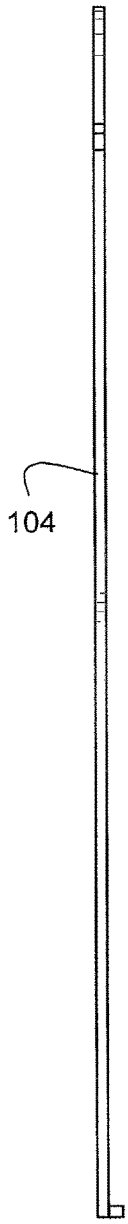
FIG. 23 is a side view of the box lid of FIG. 21.
Figure 25:
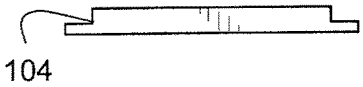
FIG. 25 is an opposite end view of the box lid of FIG. 21.

Referring to FIGS. 18-20, the box 14 can further comprise an inner shell 138 that is intermediate the top and bottom shells 84 and 66. The inner shell 138 can have the recess 58 therein. The inner shell 138 can be disposed in the bottom shell 66 and can have a snap-fit 142 with the bottom shell 66. The snap-fit 142 can comprise a protrusion extending from the bottom shell 66 and press-fitting into a bore in the inner shell 138. In addition, the inner shell 138 can have an opening 146 that matches the opening 62 in the top shell 84 and mates with the top shell 84. The openings 62 and 146 of the top and inner shells 84 and 138 can interlock at an interface 150. The interface 150 can comprise intermeshing lips and grooves, with a lip from the inner shell 138 extending into a groove in the top shell 84, and a lip from the top shell 84 extending into a groove of the inner shell 138. The interface 150, and the lips and grooves, can circumscribe the openings 62 and 146.

Figure 26:
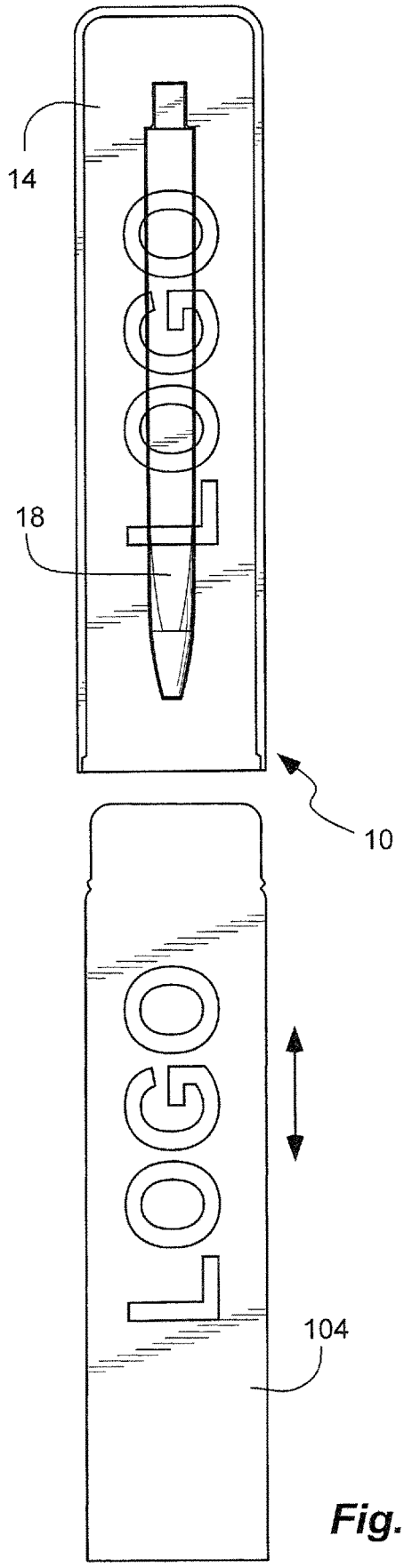
FIG. 26 is top view of the promotional item of FIG. 1, shown with the box lid in an open position.
Figure 27:
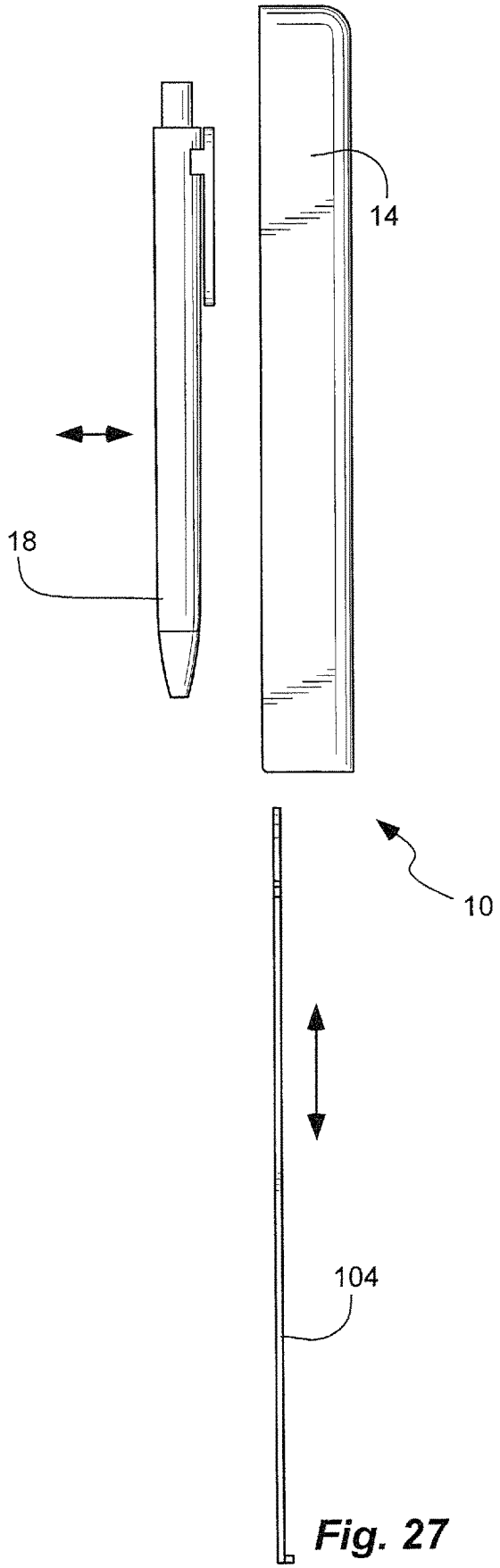
FIG. 27 is a side view of the promotional item of FIG. 1, shown with the box lid in an open position.

Referring to FIGS. 26 and 27, the promotional item 10 is shown in use with the box lid 104 being lid between the open and closed positions, and the writing instrument 18 being removed from and replaced in the box 14.

The box 14, including the top and bottom shells 84 and 66 and the box lid 104, can be formed of plastic and can be formed by injection molding. The writing instrument 18 can be a pen, part of which can be formed of plastic, such as by molding. The promotional indicia 22, including the box indicium 128 and the writing instrument indicium 130 and the upper indicium 134, can be ink or paint, and can be printed on the respective surfaces, such as by transfer pad printing. In one aspect, the box indicium 128 and the writing instrument indicium 130 can be applied at the same time, with the writing instrument 18 in the box 14. In another aspect, the box indicium 128 and the writing instrument indicium 130 can be applied separately, while the writing instrument 18 is out of the box 14.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A promotional item, comprising:

a writing instrument having a longitudinal axis and a barrel with a lateral side having a substantially flat surface extending longitudinally substantially an entire length of the barrel and extending laterally substantially an entire width of the barrel;

a box selectively carrying the writing instrument and having a top with a flat surface;

a matching recess in the box having an opening in the flat surface substantially matching a profile of the writing instrument; and the flat surface of the writing instrument being substantially flush with the flat surface of the box when the writing instrument is carried by the box and positioned in the recess.

2. The promotional item of claim 1, further comprising:

promotional indicia disposed on the flat surface of the box and the flat surface of the writing instrument.

3. The promotional item of claim 2, wherein the promotional indicia further comprises:

a box indicium on the flat surface of the box;

a writing instrument indicium on the flat surface of the writing instrument; and the writing instrument indicium matching the box indicium such that the box indicium continues from the flat surface of the box to the flat surface of the writing instrument except for a gap between the flat surface of the box and the writing instrument.

4. The promotional item of claim 2, further comprising:

a box lid selectively covering the recess and the writing instrument when the writing instrument is positioned in the recess, the box lid having an outer surface; and an outer indicium on the outer surface of the box lid that matches the promotional indicia on the flat surface of the box.

5. The promotional item of claim 4, further comprising:

a pair of opposite rails along opposite sides of the top of the box and raised above the flat surface of the box;

a pair of opposing channels formed in the pair of opposite rails; and the box lid slidable in the pair of opposing channels between an open position exposing the recess and a closed position covering the recess.

6. The promotional item of claim 5, wherein the flat surface of the box extends from the opening of the recess to the opposite rails.

7. The promotional item of claim 1, wherein the flat surface of the box extends continuously and uninterrupted from the opening of the recess to substantially an outer perimeter of the top.

8. The promotional item of claim 1, further comprising:

a gap between the flat surface of the box and the writing instrument; and the gap having a distance less than 2 mm between the lateral side of the writing instrument and the top of the box for at least majority of a longitudinal length of the lateral side of the writing instrument.

9. The promotional item of claim 8, further comprising:

promotional indicia disposed on the flat surface of the box and the flat surface of the writing instrument; and the promotional indicia extending across the flat surfaces of the box and the writing instrument and interrupted only by the gap between the flat surface of the box and the writing instrument.

10. The promotional item of claim 1, wherein the box further comprises:

a bottom shell comprising a bottom wall, opposite lateral side walls, and opposite end walls, with a closable top opening; and a top shell coupled to the bottom shell and closing the top opening of the bottom shell, the top shell comprising the flat surface and the opening.

11. The promotional item of claim 10, wherein the box further comprises:

an inner shell intermediate the top and bottom shells, and having the recess.

12. The promotional item of claim 10, wherein the box further comprises:

the top shell recessed with respect to the opposite lateral side walls to define a pair of opposite rails raised above the top shell and the flat surface of the box;

a pair of opposing channels formed in the pair of opposite rails; and a box lid slidable in the pair of opposing channels between an open position exposing the recess and a closed position covering the recess.

13. The promotional item of claim 12, further comprising:

promotional indicia disposed on the flat surface of the box and the flat surface of the writing instrument;

an outer indicium on the outer surface of the box lid that matches the promotional indicia on the flat surface of the box.

14. A promotional item, comprising:

a writing instrument having a longitudinal axis and a barrel with a lateral side having a substantially flat surface extending longitudinally substantially an entire length of the barrel and extending laterally substantially an entire width of the barrel;

a box selectively carrying the writing instrument and having a top with a flat surface;

a matching recess in the box having an opening in the flat surface substantially matching a profile of the writing instrument;

the flat surface of the writing instrument being substantially flush with the flat surface of the box when the writing instrument is carried by the box and positioned in the recess; and promotional indicia disposed on the flat surface of the box and the flat surface of the writing instrument, the promotional indicia comprising:

a box indicium on the flat surface of the box;

a writing instrument indicium on the flat surface of the writing instrument; and the writing instrument indicium matching the box indicium such that the box indicium continues from the flat surface of the box to the flat surface of the writing instrument except for a gap between the flat surface of the box and the writing instrument.

15. The promotional item of claim 14, further comprising:

a box lid selectively covering the recess and the writing instrument when the writing instrument is positioned in the recess, the box lid having an outer surface; and an outer indicium on the outer surface of the box lid that matches the promotional indicia on the flat surface of the box.

16. The promotional item of claim 15, further comprising:

a pair of opposite rails along opposite sides of the top of the box and raised above the flat surface of the box;

a pair of opposing channels formed in the pair of opposite rails; and the box lid slidable in the pair of opposing channels between an open position exposing the recess and a closed position covering the recess.

17. The promotional item of claim 16, wherein the flat surface of the box extends from the opening of the recess to the opposite rails.

18. The promotional item of claim 14, further comprising:

a gap between the flat surface of the box and the writing instrument; and the gap having a distance less than 2 mm between the lateral side of the writing instrument and the top of the box for at least majority of a longitudinal length of the lateral side of the writing instrument.

19. A promotional item, comprising:

a writing instrument having a longitudinal axis and a barrel with a lateral side having a substantially flat surface extending longitudinally substantially an entire length of the barrel and extending laterally substantially an entire width of the barrel;

a box selectively carrying the writing instrument and comprising:

a bottom shell comprising a bottom wall, opposite lateral side walls, and opposite end walls, with a closable top opening;

a top shell coupled to the bottom shell and closing the top opening of the bottom shell;

the top shell comprising a flat surface;

a matching recess in the top shell and having an opening in the flat surface substantially matching a profile of the writing instrument;

a pair of opposite rails raised above the top shell and the flat surface of the box defined by the top shell being recessed with respect to the opposite lateral side walls;

a pair of opposing channels formed in the pair of opposite rails;

a box lid slidable in the pair of opposing channels between an open position exposing the recess and a closed position covering the recess;

the flat surface of the writing instrument being substantially flush with the flat surface of the top shell of the box when the writing instrument is carried by the box and positioned in the recess;

a gap between the flat surface of the top shell of the box and the writing instrument;

the gap having a distance less than 2 mm between the lateral side of the writing instrument and the top of the box for at least majority of a longitudinal length of the lateral side of the writing instrument;

a promotional indicium disposed on the flat surface of the top shell of the box and the flat surface of the writing instrument, the promotional indicium comprising:

a box indicium on the flat surface of the top shell of the box;

a writing instrument indicium on the flat surface of the writing instrument; and the writing instrument indicium matching the box indicium such that the box indicium continues from the flat surface of the top shell of the box to the flat surface of the writing instrument except for the gap between the flat surface of the box and the writing instrument; and an outer indicium on the outer surface of the box lid that matches the promotional indicia on the flat surfaces of the writing instrument and the top shell of the box.

* * * * *